United States Patent [19]

Pierce

[11] 4,173,996

[45] Nov. 13, 1979

[54] HEAT EXCHANGER ARRANGEMENT FOR VAPORIZATION COOLED TRANSFOMERS

[75] Inventor: Linden W. Pierce, Rome, Ga.

[73] Assignee: General Electric Company, N.Y.

[21] Appl. No.: 939,195

[22] Filed: Sep. 5, 1978

[51] Int. Cl.[2] ..... F28D 15/00

[52] U.S. Cl. ..... 165/105; 165/111; 336/58; 357/82

[58] Field of Search ..... 165/105, 110, 111, 113; 361/385; 357/82; 336/58; 174/15 R

[56] References Cited

U.S. PATENT DOCUMENTS

| | | | |
|---|---|---|---|
| 1,353,855 | 9/1920 | Scanes | 165/113 |
| 4,027,728 | 6/1977 | Viobayashi | 165/105 |

*Primary Examiner*—Albert W. Davis, Jr.
*Attorney, Agent, or Firm*—Francis X. Doyle; Richard A. Menelly

[57] ABSTRACT

A one way flow and return system for vapor cooled transformer heat exchangers employs an inlet coupled with an entrance manifold and an outlet coupled with a return manifold. The incoming vaporized coolant enters the entrance manifold in a first direction of flow and the condensed vapor droplets leave the exit manifold in an opposite flow direction. The arrangement of separate entrance and exit manifolds prevents interference between the incoming vaporized coolant and the returning condensed coolant.

2 Claims, 6 Drawing Figures

6
24
20
19
21
16'
12
17
C
16"
B
D
23
25
18
28
26
27
22
29
30
A
10
15
11
16
13
14

HEAT EXCHANGER ARRANGEMENT FOR VAPORIZATION COOLED TRANSFOMERS

BACKGROUND OF THE INVENTION

U.S. patent application Ser. No. 862,352 filed Dec. 20, 1977 describes an improved heat exchanger for vaporization cooled transformers. The vaporization cooled transformers are of the type employing a low boiling point vaporizable fluid, such as trichlorotrifluoroethane, and a heat exchanger for allowing the vaporizable fluid to transfer its heat to the environment. The aforementioned U.S. Patent application improves over state of the art of heat exchangers by arranging the cooling tubes in a horizontal rather than vertical plane. It has been discovered, however, that the horizontal arrangement of cooling tubes, can present a problem with the flow rate and quantity of coolant. The provision of an inlet pipe within inlet manifold wherein the tubes are intentionally positioned at a slight angle for drainage into the entrance manifold can cause the returning vapor droplets to impede the flow of incoming vaporized coolant. This is especially noticeable both under conditions of transformer overload and when the transformer is first energized. Upon start-up conditions a large amount of vapor is rapidly generated and forced into the heat exchanger. The substantial flow of vapor can actually push the condensed liquid droplets back into the manifold rather than allowing the droplets to return. This situation is called "Liquid hold up" and can seriously decrease the amount of liquid returning to the transformer tank. When a sufficiently low quantity of liquid occurs in the tank a liquid level indicating switch becomes energized and the transformer becomes electrically disconnected from the line.

The purpose of this invention is to provide an improved heat exchanger arrangement wherein incoming vaporized coolant assists the flow of returning condensed coolant back to the transformer tank. The location and design of the inlet and return pipes to and from the heat exchanger prevent the coolant liquid level in the transformer tank from becoming seriously diminished.

SUMMARY OF THE INVENTION

A heat exchanger arrangement for vapor cooled transformers wherein a predetermined path direction is provided for the evaporated vapor flow into the exchanger and the condensed vapor flow back to the transformer tank. An inlet is connected to the entrance manifold and an outlet is connected to the return manifold. The heat exchanger cooling tubes are downwardly inclined from the entrance manifold to the return manifold to serially connect both manifolds and promote the drainage of vaporized coolant back to the transformer tank. The serial connection between the entrance and return manifolds causes the incoming vaporized coolant to force the condensed coolant back to the transformer tank in a continuous flow path.

DESCRIPTION OF THE PREFERRED EMBODIMENT

Figure 1:
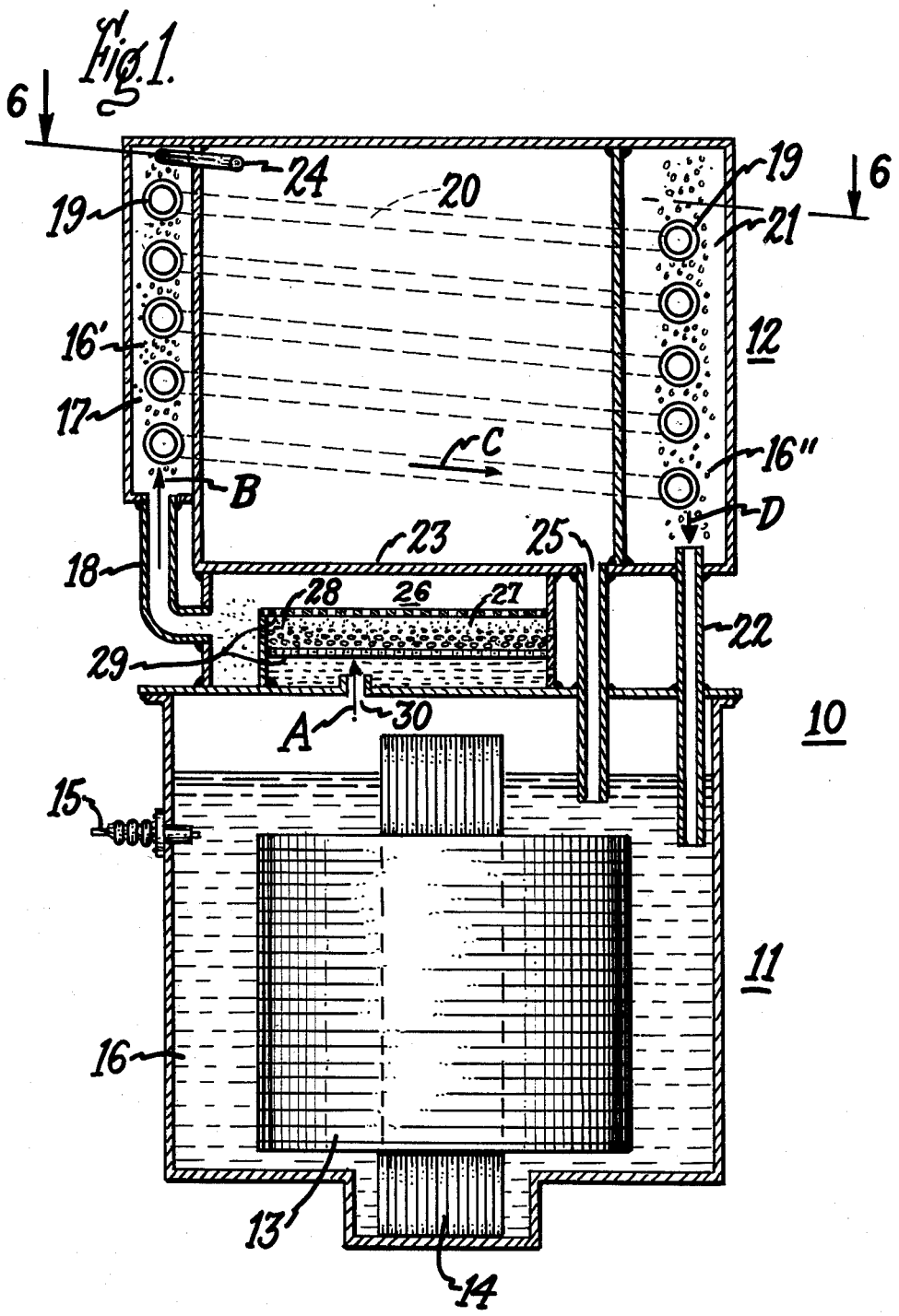
FIG. 1 is a front sectional view of a vapor cooled transformer including the heat exchanger arrangement according to the invention.

The improved heat exchanger arrangement of the invention can be seen by referring to FIG. 1 wherein a vapor cooled transformer 10 of the type containing a tank 11 and a heat exchanger 12 for the purpose of cooling a plurality of windings 13 around a core 14 and also for cooling a feedthrough bushing 15 which provides electrical connection to the windings. The coolant 16 such as a trichlorotrifluoroethane carries the heat away from the windings by evaporation up into an intake manifold 17 by means of an intake pipe 18. Since the mechanism of heat transfer comprises the evaporation and condensation of coolant 16 for purposes of this disclosure the vaporized coolant will be shown in small dots and designated 16' and the condensed coolant will be described as larger dots and designated 16''. The vaporized coolant 16' flows out into a plurality of headers 19 and from there into a plurality of cooling tubes 20 wherein the coolant condenses and drains down the cooling tubes 20 into return manifold 21. The condensed coolant 16'' returns to the tank by means of return pipe 22. An expansion tank 23 is provided to allow for the displacement of any noncondensible gases that may be present within the exchanger at the time the transformer becomes energized. The expansion tank 23 comprises three divided sections, the first forming the intake manifold 17, the second forming the return manifold 21 and the remaining volume forming the expansion area. Any coolant which passes into the expansion tank by means of connector 24, returns back to the tank by means of expansion return pipe 25. As described within the aforementioned U.S. patent application, incorporated herein by way of reference, a chamber 26 is included between the heat exchanger and the transformer tank and includes a container 27 full of molecular sieve material 28 and a plurality of slots 29. The vaporized coolant 16' enters into the container of molecular sieves by means of opening 30 which connects the chamber with the tank.

Figure 2:
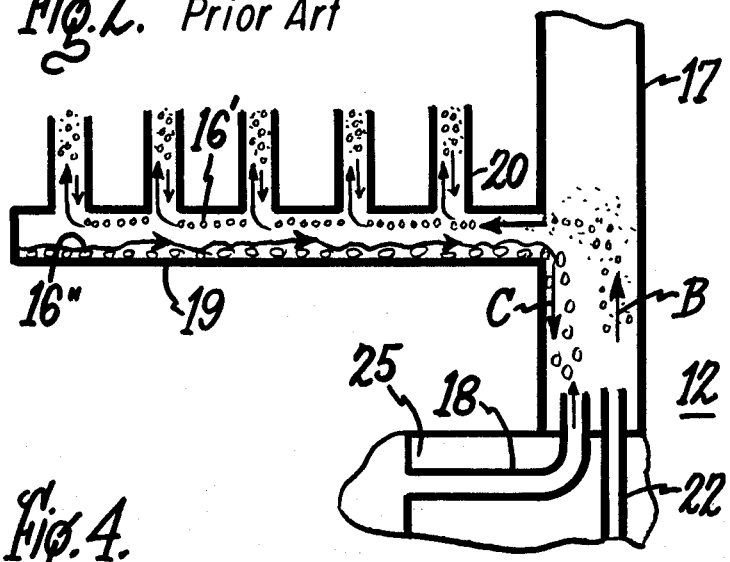
Fig. 2. Prior Art
FIG. 2 is a side sectional view of a portion of a prior art heat exchanger manifold containing directional arrows to indicate the direction of vapor flow for vaporized and condensed coolant.
Figure 3:
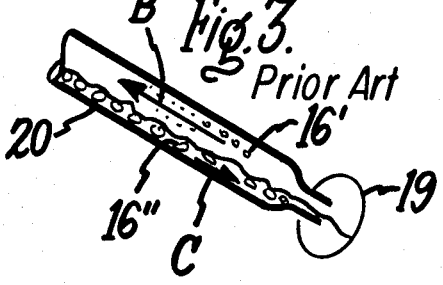
Fig. 3. Prior Art
FIG. 3 is an enlarged side sectional view of one of the cooling tubes used within the prior art heat exchanger of FIG. 2 containing coolant directional flow arrows.

The principle of operation is as follows. The coolant 16' passes through opening 30 in the direction indicated at arrow A, passes through molecular sieve material 28, and enters the intake manifold in the flow direction indicated by arrow B. The vaporized coolant 16' enters into the cooling tubes 20 and flows in the direction indicated by arrow C. After condensing within the cooling tubes the condensed coolant 16'' passes down the return manifold 21 in the direction indicated by arrow D into the return pipe 22 and back to the tank. It is to be noted that the direction of flow from the tank through the heat exchanger back to the tank is in one continuous path. This is an important feature of the invention since the coolant 16' builds up a sufficient quantity of gas pressure to force the condensed coolant 16″ out through the cooling tubes into the return manifold 21 and back to the tank. This is in contrast to the prior art arrangement shown in FIG. 2, wherein the heat exchanger 12 contains an inlet pipe 18 and return pipe 22 within a common intake and return manifold 17. The flow direction for the coolant 16′ is shown by directional arrows B and the flow direction for the condensed coolant 16″ is shown by directional arrows C. It can be seen therefore, that the vaporized coolant 16′ is attempting to enter manifold 17 in counter flow to condensed coolant 16″ which is trying to return to the tank. This is true also in header 19 wherein the vaporized coolant 16′ is flowing in counter direction to condensed coolant 16″. This occurs also in cooling tubes 20 wherein the vaporized coolant is attempting to enter the tubes in the opposite direction. FIG. 3 shows the vaporized coolant 16′ flowing in tube 20 in the direction of arrow B while the flow path of condensed coolant 16″ is in the direction of arrow C back to header 19.

Figure 4:
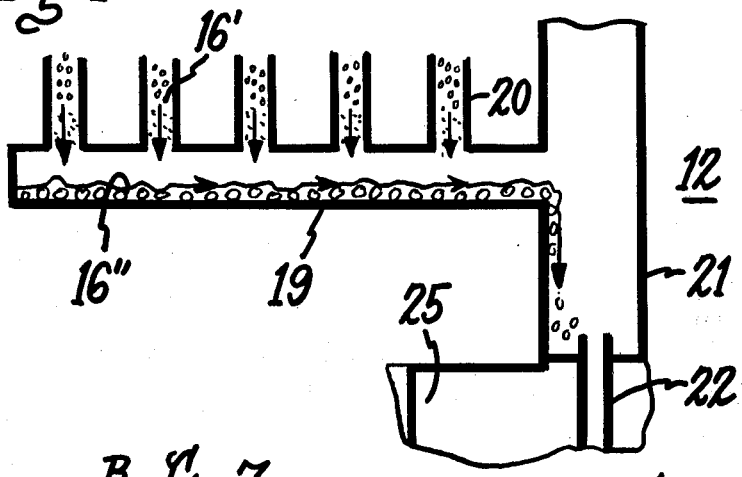
FIG. 4 is a side sectional view of a portion of the heat exchanger of FIG. 1 including coolant directional flow arrows.
Figure 5:
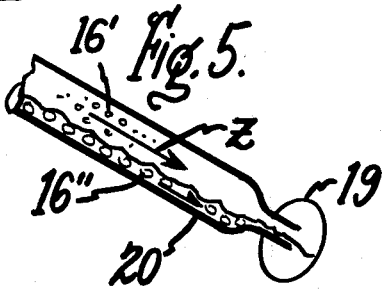
FIG. 5 is an enlarged side sectional view of one of the cooling tubes used within the embodiment of FIG. 4.

The controlled flow arrangement of the invention can be seen in better detail in FIG. 4 which contains a part of the heat exchanger of the embodiment of FIG. 1 wherein the heat exchanger 12 contains a separate return manifold 21 and a separate return pipe 22 for the condensed coolant 16″. The arrangement of a separate intake and return provides for a controlled flow rate wherein both the coolant 16′ and condensed coolant 16″ both flow in the same direction. The pressure generated by the vaporized coolant, rather than impede the flow of condensed coolant as with prior arrangements, aids in the return flow of the condensed coolant by providing a dynamic gas pressure in the same direction as the flow path of the condensed coolant. The flow of the vaporized coolant and condensed coolant in header 19 is indicated by common flow directional path arrow Z. The common flow path also occurs in cooling tubes 20 and in return manifold 21. FIG. 5 shows a cooling tube 20 in an enlarged view and at an angle of inclination toward header 19 wherein the flow rate of condensed coolant 16″ and vaporized coolant 16′ have the same flow direction as indicated by arrow Z.

Figure 6:
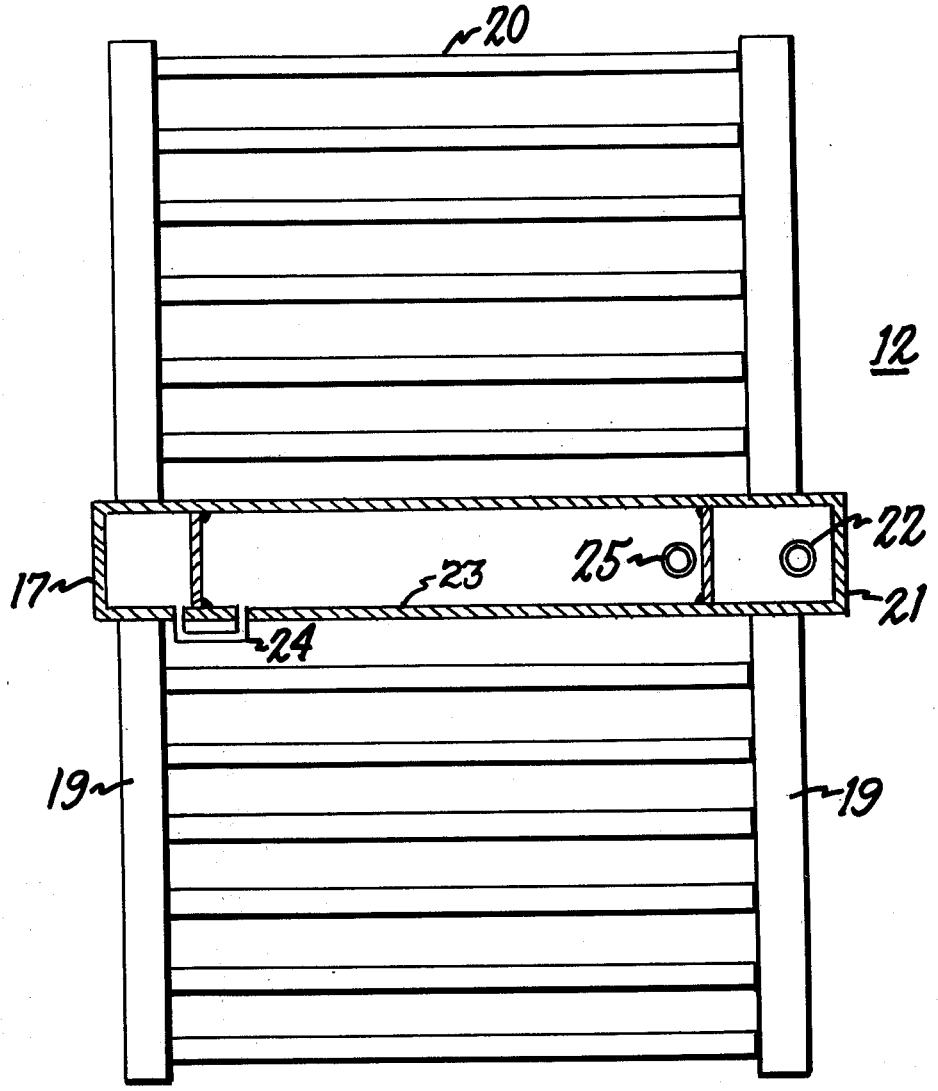
FIG. 6 is a top view in partial section of the heat exchanger of FIG. 1 taken through the plane 6—6.

FIG. 6 shows the improved heat exchanger of FIG. 1 for comparison with the heat exchanger disclosed within the aforementioned U.S. patent application. The interconnection between the intake manifold 17 and the expansion tank 23 by connector 24, and the incorporation of the separate return 25 within expansion tank 23 as well as the separate return 22 in the exit manifold 21 can be seen in greater detail.

Although the improved heat exchanger arrangement of the invention is described with use with vapor cooled transformers this is by way of example only. The improved heat exchanger of the invention finds application wherever a condensible coolant is to be employed for cooling any type of heated equipment whatsoever.

What is claimed as new, and desired to be secured by Letters Patent of the United States is;

1. An improved heat exchanger of the type used with condensable coolants and including an intake manifold and a return manifold and a plurality of cooling tubes connecting between both of said manifolds wherein the improvement comprises:

an intake pipe connecting with the intake manifold for promoting the flow of vaporized coolant into the intake manifold;

a return pipe connecting with the return manifold for promoting the flow of condensed coolant out of the return manifold said vaporized coolant and condensed coolant flow being in the same direction within the return manifold;

said cooling tubes inclining from the intake manifold to the exhaust manifold to promote the flow of condensed coolant into the return manifold, said vaporized coolant and condensed coolant flow being in the same direction within the cooling tubes;

an expansion tank forming three divided sections which create the intake and return manifolds and an expansion area intermediate the intake and return manifolds and a connector between the intake manifold and the expansion tank for providing the flow of vaporized coolant into the expansion tank; and a separate return pipe connecting with the expansion tank for promoting the flow of condensed coolant out of the expansion tank.

2. The improved heat exchanger of claim 1 wherein the connector is attached to the expansion tank at a top portion thereof and the return pipe is attached to the expansion tank at a bottom portion thereof for promoting the flow of vaporized coolant into the expansion tank and the flow of condensed coolant out of said tank.

* * * * *